US009939765B2

(12) United States Patent
Shkuri et al.

(10) Patent No.: US 9,939,765 B2
(45) Date of Patent: Apr. 10, 2018

(54) FAULT DETECTION

(71) Applicant: HEWLETT-PACKARD INDIGO B.V., Amstelveen (NL)

(72) Inventors: Kobi Shkuri, Nes Ziona (IL); Sasi Moalem, Nes Ziona (IL); Rafael Kahatabi, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/302,312

(22) PCT Filed: Apr. 9, 2014

(86) PCT No.: PCT/EP2014/057197
§ 371 (c)(1),
(2) Date: Oct. 6, 2016

(87) PCT Pub. No.: WO2015/154805
PCT Pub. Date: Oct. 15, 2015

(65) Prior Publication Data
US 2017/0031288 A1 Feb. 2, 2017

(51) Int. Cl.
*G03G 15/00* (2006.01)

(52) U.S. Cl.
CPC ..... *G03G 15/5033* (2013.01); *G03G 15/55* (2013.01); *G03G 15/752* (2013.01)

(58) Field of Classification Search
CPC .. G03G 15/5033; G03G 15/55; G03G 15/751; G03G 15/752
See application file for complete search history.

(56) References Cited

U.S. PATENT DOCUMENTS 3,588,242 A 6/1971 Berlier et al.
3,926,515 A * 12/1975 Nagahara ..... G03G 15/752 399/161
4,076,183 A * 2/1978 Kingsley ..... G03G 15/752 242/538.3
4,239,375 A * 12/1980 Eisbein ..... G03G 15/752 242/538.3
5,138,380 A * 8/1992 Umeda ..... G03G 15/55 399/26
5,335,054 A * 8/1994 Landa ..... G03G 5/04 219/216
5,508,790 A 4/1996 Belinkov et al.
5,689,756 A 11/1997 Taki et al.
7,723,710 B2 5/2010 Campidell et al.
8,208,826 B2 6/2012 Takahashi
(Continued)

FOREIGN PATENT DOCUMENTS

EP 2128712 12/2009

OTHER PUBLICATIONS

Nakayama, O. et al., Development of Surface Inspection Machine for Organic Photo Conductor (OPC), Dec. 13-15, 1994.

*Primary Examiner* — Sophia S Chen
(74) *Attorney, Agent, or Firm* — HP Inc. Patent Department

(57) ABSTRACT

According to one example, there is provided apparatus for detecting a fault in a printing system. The apparatus includes a monitoring module to determine the length of a portion of an imaging member as the imaging member rotates; and indicate a fault condition when the determined length is different to a reference length.

11 Claims, 4 Drawing Sheets

(56) References Cited

U.S. PATENT DOCUMENTS

| | | | | |
|---|---|---|---|---|
| 8,472,817 | B2 * | 6/2013 | Konishi | G03G 15/55 399/26 |
| 2007/0297821 | A1 | 12/2007 | Yamauchi et al. | |
| 2009/0296147 | A1 * | 12/2009 | Kinukawa | G03G 15/1605 358/1.15 |
| 2011/0052229 | A1 | 3/2011 | Shishikura et al. | |

* cited by examiner

FAULT DETECTION

CROSS-REFERENCE TO RELATED APPLICATION

This application is a U.S. National Stage Application of and claims priority to International Patent Application No. PCT/EP2014/057197, filed on Apr. 9, 2014, and entitled "FAULT DETECTION," which is hereby incorporated by reference in its entirety.

BACKGROUND

Some printing systems use photoconductors on which may be generated a latent electrostatic image. A dry powder or liquid toner may be developed on a photoconductor and be subsequently transferred, either directly or indirectly, to a media.

Photoconductors are generally a costly element of a printing system. The longevity of a photoconductor may thus have a direct impact on the cost of printing.

BRIEF DESCRIPTION

Examples of the invention will now be described, by way of non-limiting example only, with reference to the accompanying drawings, in which.

DETAILED DESCRIPTION

One kind of printing system that use a photoconductor are liquid electro-photographic (LEP) printing systems, such as the range of Indigo Digital Presses available from Hewlett-Packard Company.

LEP printers, for example, use an imaging member comprising a removable outer photoconductor foil. In some examples the imaging member may be a drum, although in other examples the imaging member may be a belt.

Figure 1:
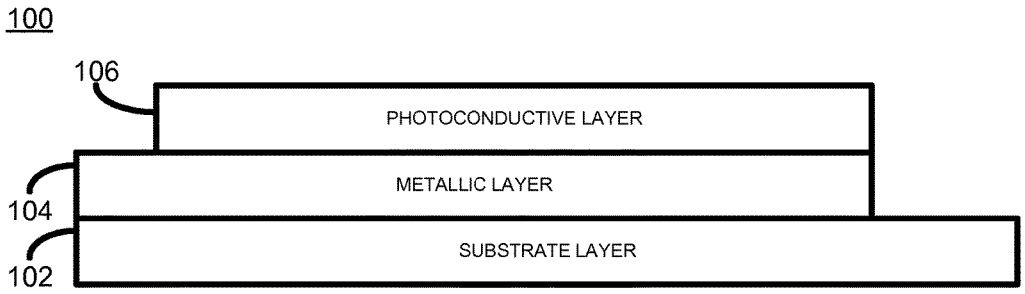
FIG. 1 is an illustration showing a cross-section of layers of a photoconductor foil according to one example.

A photoconductor foil may comprise multiple layers, as illustrated in the cross-section shown in FIG. 1. In FIG. 1 a photoconductor foil 100 having a base or substrate layer 102, a metallic layer 104, and a photoconductor foil 100 is shown. In other examples a photoconductor foil may comprise more layers. Although FIG. 1 shows each of the layers as having the same thickness an actual photoconductor foil may have layers of different thicknesses. In one example, at the trailing edge (shown on the right-hand side in FIG. 1) of the photoconductor foil 100 the substrate layer 102 is longer than the other layers 104 and 106. At the leading edge (shown on the left-hand side in FIG. 1) of the photoconductor foil 100 the substrate layer 102 and metallic layer 104 are longer than the photoconductive layer 106.

Figure 2:
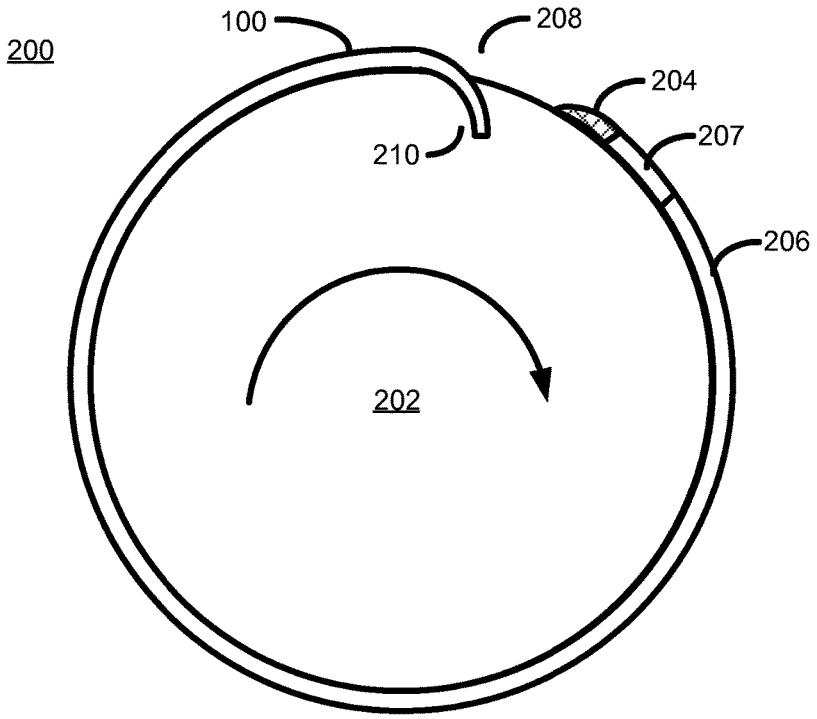
FIG. 2 is an illustration showing a cross-section of an imaging member according to one example.

FIG. 2 is a cross-sectional view of a portion of an imaging member 200 in the form of a drum. The imaging member 200 has a core or drum member 202 around which is installed the photoconductor foil 100

In the example shown in FIG. 2, it can be seen that the photoconductor foil 100 does not cover the entire outer surface of the drum 202, although in some examples it may cover the whole outer surface of the drum 202.

When installed on the drum 202, the photoconductor foil 100 thus comprises a photoconductive portion 206 and a non-photoconductive section 207 at one end of the foil 100 where the substrate layer 102 is longer than the other layers 104 and 106. The leading edge 208 of the photoconductor foil 100 is inserted into the drum in an attachment slot 210. This enables the metallic layer to be electrically grounded when inserted into the drum 202, whilst the photoconductive layer 106, being shorter, is not inserted into the drum 202. The trailing edge of the photoconductor foil 100, i.e. the end comprising just the substrate layer 102, photoconductor foil 100 is attached to the imaging member 200 through an attachment mechanism 204. The attachment mechanism 204 may be any suitable attachment mechanism, such as a clamp, a suction cup or array of suction cups, a vacuum system, or the like. In some examples adhesion of the photoconductor foil 100 may be enhanced through application of a thin layer of oil, or other suitable material, along the whole or a portion of the underside of the photoconductor foil 100.

This arrangement allows the photoconductor foil 100 to be replaced, without having to replace the whole imaging member 200. This is useful since the properties of the photoconductor foil 100 may deteriorate through use leading to print quality issues.

The printing system 200 in which the imaging member 200 is used is configured to only use the portion of the surface of the photoconductor foil 100 that is covered by the photoconductive layer 106 for printing operations.

Due to the replaceable nature of the photoconductor foil 100, a number of possible problems may occur which may be damaging either to the photoconductor foil 100, or to elements of a printing system in which the imaging member 200 is installed.

Figure 3:
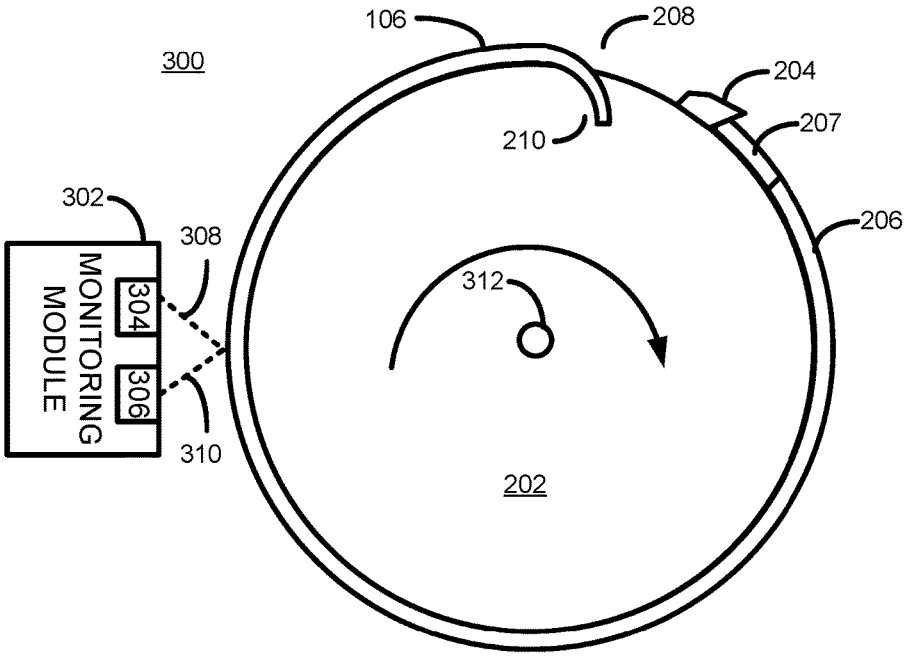
FIG. 3 is an illustration showing a cross-section of a portion of a printing system according to one example.

Referring now to FIG. 3 there is a shown a portion of a printing system 300 having a photoconductor foil monitoring module 302. It will be understood that not all elements of a printing system are shown in FIG. 3 for reasons of clarity. In one example, the printing system 300 is a liquid electro-photographic printing system.

The monitoring module 302 comprises an electromagnetic energy emitter 304, such as a light source, and an electromagnetic energy receiver 306, such as a light sensor. The emitter 304 and receiver 306 are configured such that light 308 emitted from the emitter 304 is directed to the surface of the imaging member 200, and that light 310 reflected back from the surface of the imaging member 200 is received by the receiver 306. The intensity of light received at the receiver 306 may, for example, generate an electrical signal, such as an electrical voltage, that is proportional to the amount of light received by receiver 306.

As the imaging member 200 is rotated about its rotation axis 312 the amount of light received by the receiver 306 varies, depending on whether the received light 310 is reflected from the surface of the photoconductive portion 206, from the non-photoconductive portion 207 of the photoconductor foil 100, or, if appropriate, from another portion of the imaging member 200 that is not covered by either.

Figure 4:
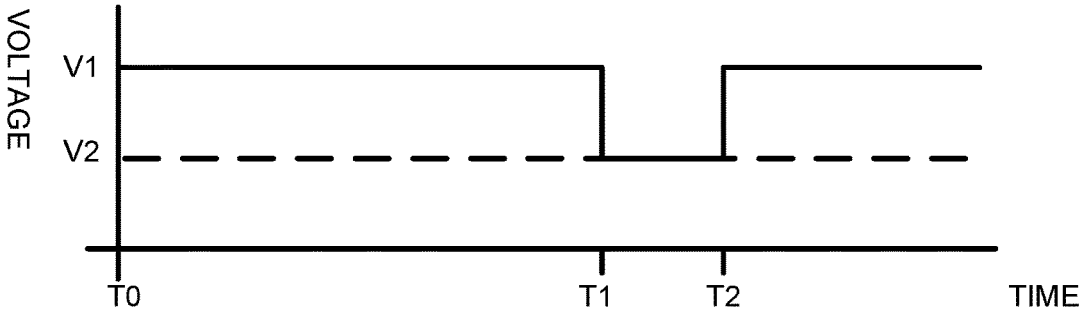
FIG. 4 is an illustration showing example signals generated by a receiver according to one example.

FIG. 4 is a graph illustrating example electrical signals generated by the receiver 306 as the imaging member 200 is rotated. At time $T_0$ a voltage of $V_1$ is generated until time $T_1$ when the voltage drops to voltage $V_2$ where it remains until time $T_2$, after which the voltage again reaches voltage $V_1$. The time period $T_0$ to $T_1$ corresponds to the time period during which light 310 is reflected from the photoconductive portion 206. The time period $T_1$ to $T_2$ corresponds to the time period during which light 310 is reflected from the non-photoconductive portion 207. In this example is it assumed that the amount of light reflected from the non-photoconductive portion 207 and any other portion of the imaging member 200 not covered by the photoconductor foil 102 is the same.

By knowing the speed of rotation of the imaging member 200 the monitoring module 302 can determine the length of the different portions 206 and 207 of the photoconductor foil 100, or may at least determine the length of the non-photoconductive portion 206. In one example the speed of rotation of the imaging member 200 may be obtained from a printer controller (not shown), a motor controller (not shown), an encoder module, or in any other suitable manner. In other examples angular rotation may be measured, for example using an angular encoder, and be used to determine the length of the portions.

The monitoring module 302 may also store reference voltage levels generated when light is reflected by different portions 206 and 207 of the photoconductor foil 100.

Figure 5:
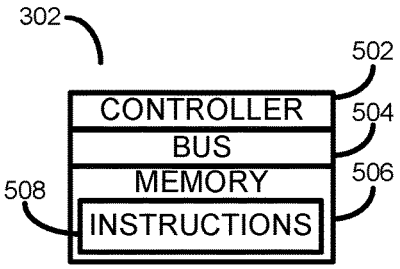
FIG. 5 is a block diagram of a monitoring module according to one example.

In one example, illustrated in FIG. 5, the monitoring module 302 comprises a controller 502, such as a microprocessor-based controller, that is coupled to a memory 506 via a communications bus 504. The memory 506 stores processor executable instructions 508. The controller 502 may execute the instructions 506 and hence control the monitoring module 302 as described herein. The memory 506 may also be used to store other data, including, for example, any of: reference voltage data; and reference length data.

Figure 6:
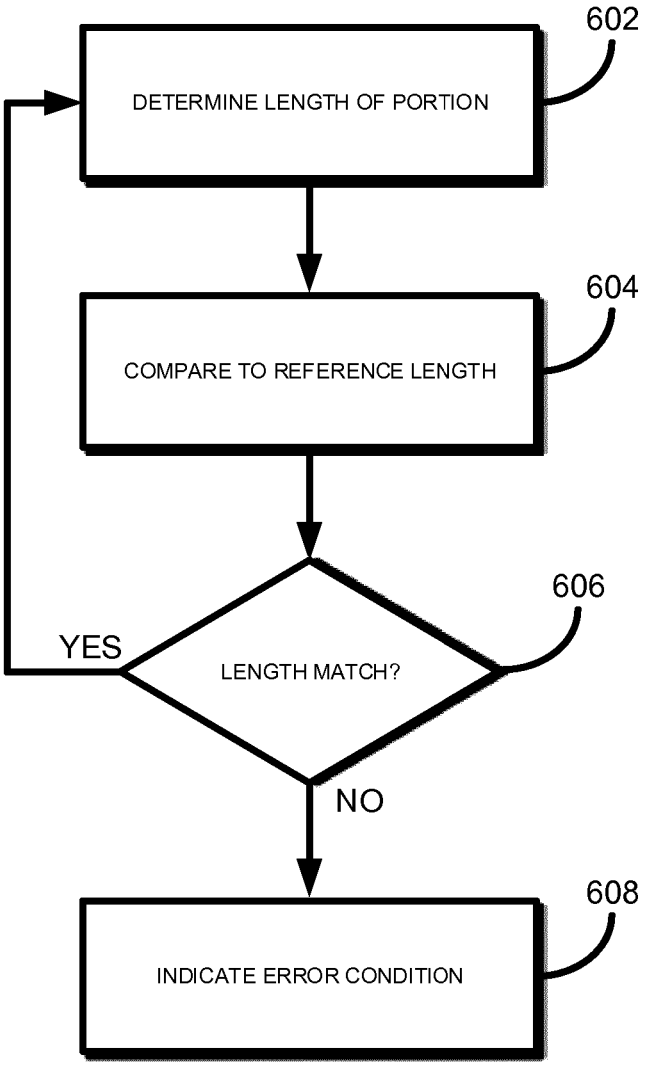
FIG. 6 is a flow diagram outlining an example method of operation a monitoring module according to one example.

A method of operating the monitoring module 302 according to one example will now be described with reference to the flow diagram of FIG. 6.

At block 602 the monitoring module 302 determines the length of a portion of the photoconductor foil 100 whilst the imaging member 200 is rotating. In one example the monitoring module 302 determines the length of the non-photoconductive portion 207. In another example the monitoring module 302 determines the length of the photoconductive portion 206. In one example the monitoring module 302 determines the length of the both the conductive portion 206 and the length of the photoconductive portion 207.

At block 604 the monitoring module 302 compares the determined length of a portion of the non-photoconductive layer 102 with a stored reference length of the corresponding portion.

At block 606 the monitoring module 302 determines whether the determined length of the non-photoconductive portion 207 matches the reference length. In one example a length match may be determined when the determined length is different to the reference length by less than about 10%. In other examples, a higher or lower percentage may be used.

If the monitoring module 302 determines that the lengths match, it determines that the photoconductor foil 100 is correctly installed on the imaging member 200. If however, it determines that the lengths do not match, the monitoring module 302 determines that the photoconductor foil 100 is not correctly installed. At block 608 the monitoring module 302 indicates a fault or error condition.

The fault condition may be indicated to a user, for example via a user interface of the printing system 300. In one example the monitoring module 302 may cause the printing system to stop operating until a verification of the installation of the photoconductor foil 100 has been performed.

Figure 7:
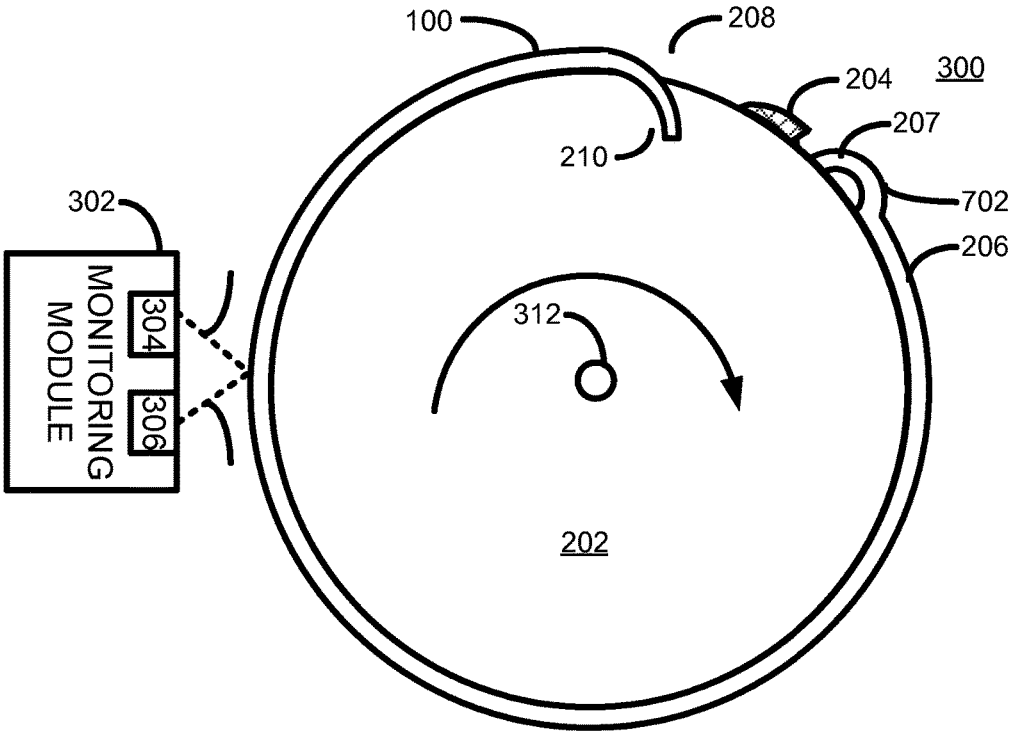
FIG. 7 is an illustration showing a cross-section of an imaging member according to one example.

One fault condition that may be detected using the monitoring module 302 is illustrated in FIG. 7. In FIG. 7 the trailing edge of the photoconductor foil 100 has become detached from the attachment mechanism 204. If this happens the non-photoconductive portion 207 may form a buckle 702 which may extend beyond the usual profile of the photoconductor foil 100. If this buckle is not detected it may result in damage to the photoconductor foil 100 or to other elements (not shown) of the printing system 300, such as ink developers, wipers, charging modules, and the like. The monitoring module 302 may detect a buckle in the photoconductor foil 100 since when a buckle forms the monitoring module 302 determines a shorter length for the non-photoconductive portion 207, which does not match with a corresponding reference length.

A further fault condition that may be detected using the monitoring module 302 is where the photoconductor foil 100 is incorrectly installed. For example, if a shorter portion of the photoconductive foil portion 206 is installed in the drum attachment slot 210, the monitoring module may determine that the length of the photoconductive portion 206 is longer than a corresponding reference length.

Prevention of such faults help prevents damage to the photoconductor foil 100 or to other elements of a printing system. This may help reduce the cost of printing for customers.

Since the photoconductive portion 206 of the photoconductor foil 100 is light sensitive in one example the monitoring module 302 may only be used within a printing system when the imaging member 200 is not being used for a printing operation.

It will be appreciated that examples described herein can be realized in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples described herein All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. An apparatus for detecting a fault in a printing system, comprising:

a monitoring module to:

determine a length of a portion of an imaging member as the imaging member rotates; and indicate a fault condition when the determined length is different to a reference length;

wherein the monitoring module comprises:

a light sensor to receive light from a light source reflected from the surface of the imaging member as the imaging member rotates; and a controller to:

determine, using signals from the light sensor, the length of a portion of the surface of the imaging member; and indicate a fault condition when the determined length is different to a reference length;

wherein the light sensor is to generate a first electrical voltage in response to receiving light reflected from a photoconductive portion of a photoconductor foil, and wherein the light sensor is to generate a second electrical voltage in response to receiving light reflected from a non-photoconductive portion of a photoconductor foil.

2. The apparatus of claim 1, wherein the monitoring module is to determine the length of a portion of a photoconductor foil installed on the imaging member as the imaging member rotates.

3. The apparatus of claim 2, wherein the monitoring module is to determine the length of a non-photoconductive portion of the photoconductor foil.

4. The apparatus of claim 2, wherein the monitoring module is to determine the length of a photoconductive portion of the photoconductor foil.

5. The apparatus of claim 1, wherein the imaging member is in the form of a drum and comprises a gripper mechanism to receive a non-photoconductive portion of a photoconductor foil, and further comprises an attachment slot for receiving a photoconductive portion of a photoconductor foil.

6. The apparatus of claim 1, wherein the monitoring module is to obtain a speed at which the imaging member is rotating.

7. The apparatus of claim 1, wherein the printing system is a liquid electro-photographic LEP printing system.

8. A method of detecting a fault in a printing system, comprising:

determining, as an imaging member is rotated, a length of a non-photoconductive portion, or a length of a conductive portion, of a photoconductor foil installed on the imaging member;

comparing the determined length with a reference length; and indicating a fault condition when the determined length does not match the reference length, wherein the fault condition is one from the set of 1) one end of the photoconductor foil has become detached from the imaging member and 2) one end of the photoconductor foil is incorrectly installed on the imaging member.

9. The method of claim 8, further comprising:

generating electrical signals in response to an amount of light reflected from the surface of the imaging member as it rotates;

determining from the electrical signals the length of a non-photoconductive portion of a photoconductor foil installed on the imaging member; and determining that one end of the photoconductor foil has become detached from the imaging member when it is determined that the determined length of the non-photoconductive portion is different to a reference length of a non-photoconductive portion.

10. The method of claim 8, wherein the detection of a fault with the imaging member is performed only when the imaging member is not being used in a printing operation.

11. A computer readable media on which are stored processor understandable instructions that, when executed by a processor, control a printing system to:

determine, as an imaging member is rotated, a length of a portion of a non-photoconductive portion of a photoconductor foil installed on the imaging member;

compare the determined length with a reference length; and indicate that the photoconductor foil has become detached from the imaging member when the determined length does not match the reference length.

* * * * *